United States Patent [19]

Blank et al.

[11] 4,354,254

[45] Oct. 12, 1982

[54] DEVICES DEPENDING ON GARNET MATERIALS

[75] Inventors: Stuart L. Blank; Ernst M. Gyorgy, both of Madison; Roy C. LeCraw, Westfield; Lars C. Luther, Basking Ridge, all of N.J.

[73] Assignee: Bell Telephone Laboratories, Incorporated, Murray Hill, N.J.

[21] Appl. No.: 204,899

[22] Filed: Nov. 7, 1980

[51] Int. Cl.[3] ..... H01F 1/37

[52] U.S. Cl. ..... 365/33; 252/62.57; 427/128; 428/692; 428/900

[58] Field of Search ..... 428/900, 692; 365/33, 365/34; 252/62.57; 427/128

[56] References Cited

U.S. PATENT DOCUMENTS

| | | | |
|---|---|---|---|
| 3,755,796 | 8/1973 | Griest, Jr. | 365/33 |
| 3,932,688 | 11/1976 | Sugita et al. | 365/33 |
| 3,995,093 | 11/1976 | Heinz | 252/62.57 |
| 4,034,358 | 7/1977 | Blank | 365/33 |
| 4,138,530 | 2/1979 | Breed et al. | 428/692 |
| 4,139,905 | 2/1979 | Blank et al. | 428/900 |
| 4,202,932 | 5/1980 | Chen et al. | 428/900 |

FOREIGN PATENT DOCUMENTS

| | | | |
|---|---|---|---|
| 2042950 | 3/1972 | Fed. Rep. of Germany | 252/62.57 |
| 2833891 | 2/1979 | Fed. Rep. of Germany | 365/34 |
| 2094608 | 2/1972 | France | 252/62.57 |

OTHER PUBLICATIONS

Krumme et al., "Control of the Uniaxial Magnetic Anisotropy in LPE-Grown Iron Garnet Films", Journal of Applied Physics, vol. 46, No. 6, 6/1975, pp. 2801-2803.

*Primary Examiner*—Stanley S. Silverman

*Attorney, Agent, or Firm*—Bernard Tiegerman; Bruce S. Schneider

[57] ABSTRACT

Devices based on epitaxial garnet layers that exhibit a high magnetic anisotropy are disclosed. These garnet layers are produced by introducing a $Co^{2+}$ or a species with 1, 2, 4, or 5 electrons in a 4d or a 5d electron orbital in the octahedral site of the garnet in conjunction with a typical anisotropy producing combination on the dodecahedral site. The contribution to magnetic anisotropy due to the typical combination on the dodecahedral site and the appropriate ion in an octahedral site is complementary.

10 Claims, 1 Drawing Figure

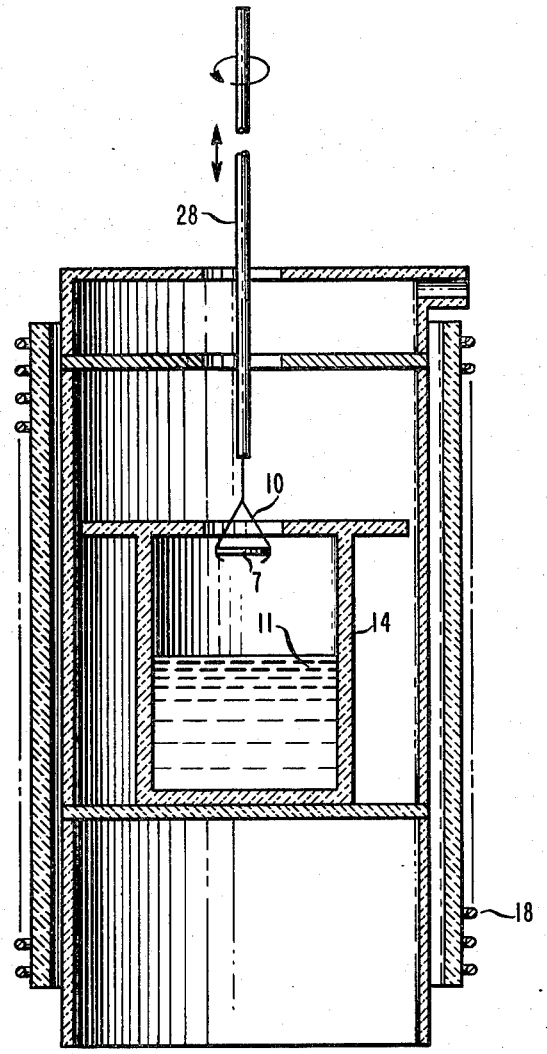
28
10
7
11
14
18

DEVICES DEPENDING ON GARNET MATERIALS

BACKGROUND OF THE INVENTION

1. Field of the Invention

This invention relates to devices relying on magnetic properties and, more particularly, those which in operation rely on magnetic properties to support single wall magnetic domains.

2. Art Background

An integral part of any magnetic bubble device is a layer of a material that has a magnetic anisotropy that is capable of supporting single wall magnetic domains. One general class of such domain supporting materials has a garnet crystal structure. Thus, the interest in magnetic devices has generated a corresponding interest in garnet materials exhibiting the necessary anisotrophy.

Generally, garnet based devices have a growth-induced magnetic anisotropy produced by ions located on the dodecahedral sites of the crystal. This growth-induced component results from the presence of a magnetic rare earth ion, such as samarium, in conjunction with a different, either magnetic or non-magnetic, rare earth ion. (For purposes of this disclosure, yttrium is considered a rare earth ion.)

The growth procedures necessary to produce such garnets are well established and are commercially viable. In using these procedures to obtain an acceptable growth-induced magnetic anisotropy, e.g., an anisotropy greater than approximately 7,000 ergs/cm$^3$, a substantial percentage of the dodecahedral sites must be filled with the necessary growth-induced anisotropy producing rare earth ions. Thus, once a suitable anisotropy is achieved in a particular crystal—especially in a material supporting small diameter magnetic domains where large growth-induced anisotropies, e.g., greater than 80,000 ergs/cm$^3$ are required—relatively few dodecahedral sites remain available for substitution. Often it is desirable to increase anisotropy or change the properties of the garnets by further substitution on the dodecahedral sites. Obviously, it is desirable to perform this substitution by well established growth procedures. As discussed in the case of garnet materials, the possibility of significant substitution on the dodecahedral site using established techniques typically is not available. Thus, the opportunity for tailoring of garnet material properties by adjusting the composition of the dodecahedral site is significantly limited.

SUMMARY OF THE INVENTION

Devices based on garnet materials having a magnetic anisotropy produced by an appropriate choice of ions both on the dodecahedral and on the octahedral sites are producible by conventional, well established growth procedures. The garnet materials employed in these devices have an anisotropy produced by a typical combination of rare earth ions on the dodecahedral site in combination with ions on the octahedral site that include (1) $Co^{2+}$ and/or (2) ions which have either 1, 2, 4, or 5 electrons in the 4d or 5d electronic orbital on the octahedral site. Exemplary of magnetic anisotrophies that are produced is approximately 18,000 ergs/cm$^3$ and 37,000 ergs/cm$^3$ for the composition $La_{0.80}Sm_{0.31}Lu_{1.89}Ga_{0.78}Fe_{4.22-x}Ir_xO_{12}$, where x is 0 and a small quantity on the order of 0.01 respectively. (For purposes of this application, yttrium is considered a rare earth ion.)

Most importantly, the contribution to growth-induced magnetic anisotrophy from the typical rare earth combination is essentially additive with the contribution to growth-induced anisotropy produced by iridium or the other requisite ions used on the octahedral site. Thus, a garnet having a desired anisotropy is producible using significantly fewer dodecahedral sites than previously necessary. Since the requisite ions on the octahedral site significantly contribute to magnetic anisotropy, it is not necessary to use an excessive amount of either the octahedral or dodecahedral sites for magnetic anisotropy control purposes.

BRIEF DESCRIPTION OF THE DRAWING

The FIGURE illustrates an apparatus useful in producing the devices of the subject invention.

DETAILED DESCRIPTION

The devices of the subject invention are typically fabricated on a supporting substrate. Any mismatch in lattice parameters between the substrate and the garnet epilayer is a source of stress. This stress induces a magnetic anisotropy in the subject garnet materials. Substantial stress and thus sustantial stress-induced uniaxial anisotropy is not desirable. For example, assuming a typical magnetostriction constant to maintain magnetic domains of useful size solely with stress-induced magnetic anisotropy requires a large lattice mismatch between the substrate and the epitaxial layer—greater than −0.015 Angstroms for garnet materials with negative magnetostriction and +0.02 for material with positive magnetostriction in films of approximately 3 μm thickness. These large mismatches usually result in cracking or dislocated growth.

It is thus advantageous that stress and the resulting stress-induced magnetic anisotropy be limited. Generally, the stress-induced component of the magnetic anisotropy should be less than 15,000 ergs/cm$^3$, preferably less than10,000 ergs/cm$^3$. (The extent of the stress-induced component of the epitaxial layer is measured by conventional techniques such as by annealing out the growth-induced anisotropy and measuring the remaining $K_u$. See R. C. LeCraw et al, *Journal of Applied Physics,* 42, 1641 (1971).)

The composition of the garnet layer growth on the substrate in accordance with the subject invention is represented by the nominal formula $\{A\}_3[B]_2(C)_3O_{12}$. The { }, [ ],and ( ), respectively, represent the dodecahedral, the octahedral, and the tetrahedral site of the garnet crystal structure. (The formula is nominal. To insure charge neutrality or because of growth defects, it is possible some slight deviations from strict stoichiometric ratios occur.) The letters A, B, and C individually represent the average composition found in the designated crystal site. Since the crystal must have a magnetic moment, for compositions of general interest, both B and C should typically include iron ions although the requisite moment produced by iron solely on B or C is not precluded if another magnetic ion is present on the B or C site to produce the necessary magnetic moment.

As in other garnet structures, the composition of A includes a typical magnetic anisotropy producing combination, i.e., where $X_{3-y}Z_y$ represents the occupants of the dodecahedral site, A, and where X is the magnetic rare earth ion of highest mole percentage in A, and Z represents the remaining constituents of A, then $0.1<y<2.9$. In addition to these constituents the number of rare earth ions necessary to produce a given anisotropy is reduced by employing on the octahedral site, either $Co^{2+}$ and/or an ion having 1, 2, 4, or 5 electrons in 4d or 5d electronic orbitals. Exemplary of ions having an appropriate number of electrons in a 4d or 5d orbital is $Ir^{4+}$. (The $Ru^{+3}$ ion falls into this category. This ion unlike the others such as $Ir^{4+}$ produces a garnet with in-plane anisotropy when the garnet film is grown on a (111) oriented substrate. Materials with in-plane anisotropy are useful, for example, as hard bubble suppressants when overlying or underlying a material with anisotropy out of plane. It should be noted that the $Ru^{+3}$ contribution to in-plane anisotropy is useful for addition to a typical combination of rare earth ions that produce in-plane anisotropy.)

Charge neutrality must be maintained in the garnet. When an ion having a 3+ charge is introduced into the garnet on an octahedral site, it replaces a 3+ iron ion and charge neutrality is not disturbed. However, if an ion having a charge other than 3+ replaces an iron ion, a net charge change in the garnet occurs and compensation is necessary. In a preferred embodiment, a charge compensator is introduced on the octahedral site. Exemplary charge compensators (those having, for example, a charge of 4+ to compensate for a 2+ ion and a charge of 2+ to compensate for a 4+ ion) are $Mg^{2+}$, $Fe^{2+}$, and $Ca^{2+}$, which compensate for 4+ ions such as $Ir^{4+}$, and $Zr^{4+}$ which compensates for 2+ ions such as $Co^{2}$.

Substitution in some octahedral and tetrahedral sites by ions other than those enumerated above to adjust the magnetic properties desired for a particular application is also possible. The limitation on this substitution is that sufficient ions having a magnetic moment, e.g. iron, remain in the octahedral and/or tetrahedral sites to produce a net magnetic moment. Similarly, enough of the requisite ion must be left on the octahedral sites to produce, in conjunction with the rare earth ions on the dodecahedral site, the desired anisotropy.

Since a significant portion of the requisite growth-induced anisotropy is producible by constituents on the octahedral site, it is possible to introduce a substantial quantity of property controlling entities on the dodecahedral site. The ions introduced onto the dodecahedral site if they have charge other than 3+ require the introduction of other constituents to maintain charge neutrality. If this is required, the neutrality is produced as discussed for substitution on the octahedral site.

Various means are available for growing the desired garnet structure. Epitaxial growth procedures employing a supercooled melt show good results. Indeed, substantially the same conditions are employed as used for the corresponding garnet without the necessary anisotropy producing octahedral ions. In a preferred embodiment, to deposit a garnet of a desired composition, the substrate, 7, is placed in a substrate holder, 10, of a conventional epitaxial growth apparatus as shown in the FIGURE. The basic deposition steps are conventional and are described in various publications such as S. L. Blank and J. W. Nielsen, *Journal of Crystal Growth,* 17, 302–11 (1972). Briefly, in the preferred embodiment the melt is heated for a sufficient period to allow equilibration of its components. The temperature of the melt is then lowered to supercool it. The substrate is introduced above the melt to preheat it and then is lowered into the melt. During growth, in a preferred embodiment, the substrate is rotated through rotaton of rod, 28.

The choice of the melt composition used in the deposition process relies on essentially the same considerations employed when conventional garnet layers are fabricated. (See S. L. Blank et al, *Journal of the Electrochemical Society,* 123, (6), 856 (1976) and S. L. Blank and J.W. Nielsen, *Journal of Crystal Growth,* 17, 302–11 (1972).) As with conventional garnets, the melt compositionis adjusted to produce the desired formulation for A, B, and C. For example, for a garnet useful in the inventive devices such as $(YSmLu)_3$ $(FeIr)_5O_{12}$ iron to rare earth atomic ratios in the melt in the range 12 to 30 while garnet oxide to flux atomic ratios in the range 0.10 to 0.28 are utilized. For such compositional ranges deposition temperatures in the range 800 to 1000 degrees C. are advantageously employed. In the previous example, it is contemplated that $Fe^{2+}$ is the compensator for the $Ir^{4+}$.

Thus, in this situation, althugh no extra component need be added to the melt the presence of $Fe^{2+}$ is required. Under atmospheric conditions, i.e., air at standard temperature and pressure, $Fe^{2+}$ is always present and is incorporated into the garnet as a compensator. However, it is possible to introduce other compensators, e.g., $Zn^{2+}$ and $Mg^{2+}$, into the grown garnet by adding an appropriate oxide, e.g., MgO or ZnO, to the melt. Typically, added compensator-to-anisotropy-producing-entity ratios in the melt up to 100-to-1 are employed. For example, Mg to Ir ratios up to 100-to-1 are used to produce the necessary compensation for a composition such as $(YSmLu)_3$ $(FeGaIrMg)_5$ $O_{12}$. It has been found that these added compensators increase the obtainable $K_u$. A contemplated explanation is that they increase the amount of available compensator and thus increase the amount of anisotropy producng ion which it is possible to incorporate in the octahedral site of the crystal.

As previously discussed, it is also possible to introduce various ions both on the octahedral, tetrahedral, and dodecahedral sites into the melt to produce certain desired properties in the resulting garnet. For example, to adjust the lattice constant to closely match that of a $Gd_3Ga_5O_{12}$ garnet (GGG) or another desired substrate material, appropriate ions, e.g., lanthanum or lutetium is added to a melt containing yttrium, samarium iron and iridium. The optimum melt composition to yield the desired garnet composition is determined by employing the criteria of S. L. Blank and J. W. Nielsen et al, supra, as an initial guide and then by using a controlled sample to fix the precise melt composition.

Once the garnet layer is deposited, it is possible to provide a means for propagating magnetic bubbles in the garnet. Typically, this means is a permalloy pattern which is deposited on the garnet layer using conventional lithographic techniques. (See, for example, Bobeck et al, *Proceedings of the IEEE,* 63, 1176 (1975).) Additionally, a means of detecting single wall domains and of producing these domains is also required. Typically, the detector is fabricated using standard lithographic techniques to produce an appropriate permalloy pattern. Similarly, a single wall magnetic domain nucleator is produced by lithographic techniques. (See Bobeck et al, supra.) A means for maintaining the single wall magnetic domains after its nucleation is also required as a component of a bubble device. This means is generally a permanent magnet surrounding the garnet layer with its associated detecting, propagating, and nucleating means.

The following are examples of typical conditions utilized in the deposition of the garnet epitaxial layer and contrast the anisotropy attainable with and without appropriate substitution on the octahedral site:

EXAMPLE 1

A circular GGG ($Gd_3Ga_5O_{12}$) substrate measuring $\frac{3}{4}$ inches in diameter and 20 mils thick was used as the deposition substrate. This substrate, 7, (in the FIGURE) was cleaned, dried, and then inserted in the substrate holder, 10, of an apparatus containing a previously prepared melt composition, 11. This melt composition was prepared by inserting a mixture of approximately 1.43 g $Y_2O_3$, 1.31 g $Sm_2O_3$, 3.62 g $Lu_2O_3$, 44.0 g $Fe_2O_3$, 10.85 g $B_2O_3$, and 500.0 g PbO in a platinum crucible, 14. The melt was heated using resistant heating coils, 18, to a temperature of approximately 1020 degrees C.

Once a temperature of 1020 degrees C. was established the melt, 11, was allowed to react for a period of approximately 16 hours. The temperature of the melt was then lowered to a growth temperature of approximately 930 degrees C. The substrate was lowered to within 1 cm of the melt surface by lowering rod, 28. The substrate was maintained in this position for approximately 6 minutes. The substrate was then immersed approximately 2 cm into the melt by again lowering rod, 28, and a rotation of 100 rpm was imparted to the substrate through rod, 28. This rotation was maintained for approximately 2 minutes and the substrate then removed from the melt to a position 1 cm above the melt while continuing the rotation. The rotation was then increased to 400 rpm for a period of $\frac{1}{2}$ minute. The rotation was discontinued and the substrate removed from the deposition area by extracting rod, 28, at a rate of approximately $\frac{1}{2}$ cm/min.

A continuous adherent garnet film was obtained. This film had a thickness of approximately 3 μm and exhibited a $K_u$ of approximately 86,600 ergs/cm$^3$ and a lattice constant within 0.002 Angstroms of the substrate lattice parameter.

EXAMPLE 2

The procedure of Example 1 was followed except before growth an addition of 0.525 g $IrO_2$ and 0.525 MgO was made to the melt at approximately 1020 degrees C. and the mixture was stirred for approximately 1 minute to insure homogeneity. The garnet film obtained was approximately 3.5 μm thich with a $K_u$ of 196,200 ergs/cm$^3$ and a lattic constant within 0.004 Angstroms of the substrate lattice parameter.

EXAMPLE 3

The procedure of Example 1 was followed except that the melt contained 3.03 g $La_2O_3$, 0.27 g $Sm_2O_3$, 2.68 g $Lu_2O_3$, 4.51 g $Ga_2O_3$, 45.15 g $Fe_2O_3$, 6.80 $B_2O_3$, and 379 g PbO. The growth temperature was approximately 900 degrees C. and the growth time was 6 minutes. The resulting film was 3.8 μm thick, had a magnetic moment of 676 Gauss, a $K_u$ of 17,800 ergs/cm$^3$ and a line width of 890 Oe.

EXAMPLE 4

The procedure of Example 3 was followed except an addition of 0.207 g $IrO_2$ and 0.102 g MgO was made at approximately 1020 degrees C. before growth. The thickness of the new film was 4.1 μm, the moment was 692 Gauss, the $K_u$ was 37,400 ergs/cm$^3$ and the line width was 880 Oe. The line width as compared to that obtained in Example 3 had not changed with the addition of Ir within the uncertainty of the measurement.

We claim:

1. A device comprising (1) an epitaxial layer of garnet material having a uniaxial magnetic anisotropy of magnitude greater than 7000 ergs/cm$^3$ which due to a growth-induced component is capable of supporting a single wall magnetic domain (2) means for producing and means for maintaining in said garnet said single wall magnetic domain (3) means for propagating said single wall domain in said garnet and (4) means for detecting the presence of said single wall magnetic domain, such that said garnet material comprises a composition nominally represented by the formula $\{A\}_3[B]_2(C)_3O_{12}$, wherein said composition includes sufficient iron ions to produce a magnetic moment in said garnet characterized in that B also includes a magnetic anisotropy producing member of the group consisting of $Co^{2+}$ and an ion having 5d or 4d electrons wherein the number of said electrons is 1, 2, 4 or 5, and A includes a typical combination capable of producing a magnetic anisotropy, said typical combination represented by A being $X_{3-y}Z_y$ where X is the magnetic rare earth ion of highest mole fraction in A, Z is the remaining composition of A, and $0.1<y<2.9$, said anisotrpoy producing member in B producing a uniaxial magnetic anisotropy which is complementary to the uniaxial magnetic anisotropy produced by said typical combination in A.

2. The device of claim 1 wherein said ion is a charged specie of iridium.

3. The device of claim 1 wherein said ion is a charged specie of cobalt.

4. The device of claim 1 wherein said garnet contains a charge specie of Mg as a compensator.

5. A device comprising a substrate with an epitaxially deposited layer of garnet material, said garnet material having a uniaxial magnetic anisotropy of magnitude greater than 7000 ergs/cm$^3$ which due to a growth-induced component is capable of supporting a single wall magnetic domain, such that said garnet material comprises a composition nominally represented by the formula $\{A\}_3[B]_2(C)_3O_{12}$, where B and C include sufficient iron ions to produce a magnetic moment characterized in that B also includes a magnetic anisotropy producing member chosen from the group consisting of $Co^{2+}$ and an ion having 5d or 4d electrons wherein the number of said electrons is 1, 2, 4 or 5, and A includes a typical combination capable of producing a magnetic anisotropy, said typical combination represented by A being $X_{3-y}Z_y$ where X is the magnetic rare earth ion of highest mole fraction in A, Z is the remaining composition of A, and $0.1<y<2.9$, said anisotropy producing member in B producing a uniaxial magnetic anisotropy which is complementary to the uniaxial magnetic anisotropy produced by said typical combination in A.

6. The device of claim 5 wherein said garnet material includes a charged specie of Ir in B.

7. The device of claim 5 wherein said garnet material includes a charged specie of Co in B.

8. The device of claim 5 wherein said substrate is GGG.

9. The device of claim 5 wherein said garnet contains a charged specie of yttrium in A.

10. A device comprising (1) an epitaxial layer of garnet material having a uniaxial magnetic anisotropy which due to a growth-induced component is capable of supporting a single wall magnetic domain (2) means for producing and means for maintaining in said garnet said single wall magnetic domain (3) means for propagating said single wall magnetic domain in said garnet and (4) means for detecting the presence of said single wall magnetic domain characterized in that the device includes a second garnet layer contacting said epitaxial layer of garnet material, said second garnet layer composed of a material represented by the formula $\{A\}_3[B]_2(C)_3O12$, wherein B includes $Ru_{3+}$ and A includes a typical combination represented by A being $X_{3-4}Z_y$ where X is the magnetic rare earth ion of highest mole fraction in A, Z is the remaining composition of A, and $0.1<y<2.9$, said anisotropy producing member in B producing a uniaxial magnetic anisotropy which is complementary to the uniaxial magnetic anisotropy produced by said typical combination in A.

* * * * *

UNITED STATES PATENT AND TRADEMARK OFFICE

CERTIFICATE OF CORRECTION

PATENT NO. : 4,354,254

DATED : October 12, 1982

INVENTOR(S) : Stuart L. Blank, Ernst M. Gyorgy, Roy C. LeCraw, and Lars C. Luther It is certified that error appears in the above—identified patent and that said Letters Patent is hereby corrected as shown below:

In the Specification, column 1, line 68, "anisotrophy" should read --anisotropy--. Column 3, line 40, "anisotropy" should read --magnetic anisotropy--. Column 4, line 6, 'sitionis" should read --sition is--. Column 5, line 46, "thich" should read --thick--. Column 6, line 9, "domain" should read --magnetic domain--; line 23, "anisotrpoy" should read --anisotropy--.

Signed and Sealed this

*Twenty-second* Day of *February 1983*

[SEAL]

*Attest:*

GERALD J. MOSSINGHOFF

*Attesting Officer*

*Commissioner of Patents and Trademarks*